US006180179B1

(12) United States Patent
Kawaguchi et al.

(10) Patent No.: US 6,180,179 B1
(45) **Date of Patent: *Jan. 30, 2001**

(54) DISPLACE DEPOSITION-PLATED AND DOPING-MODIFIED METAL MATERIAL AND PROCESS FOR PRODUCING SAME

(75) Inventors: Jun Kawaguchi; Ryosuke Kawagoshi; Kazuhiko Mori, all of Tokyo (JP)

(73) Assignee: Nihon Parkerizing Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/088,362

(22) Filed: Jun. 2, 1998

(30) Foreign Application Priority Data

Jun. 2, 1997 (JP) ..... 9-157318

(51) Int. Cl.[7] ..... B05D 1/36; B05D 1/18
(52) U.S. Cl. ..... 427/405; 427/419.8; 427/436
(58) Field of Search ..... 427/405, 406, 427/419.8, 436, 437, 438; 148/240

(56) References Cited

U.S. PATENT DOCUMENTS

| | | | | |
|---|---|---|---|---|
| 3,162,512 | * | 12/1964 | Robinson | 427/405 |
| 3,664,933 | * | 5/1972 | Clauss | 204/38 S |
| 4,088,803 | * | 5/1978 | Kubo et al. | 427/123 |
| 4,092,448 | * | 5/1978 | Coll-Palagos | 427/383 D |
| 4,167,460 | * | 9/1979 | Tomaszewski | 204/51 |
| 4,211,824 | * | 7/1980 | Yoshida | 428/462 |
| 4,374,876 | * | 2/1983 | El-Shazly et al. | 427/443.1 |
| 4,865,772 | * | 9/1989 | Suehiro et al. | 252/512 |
| 5,241,394 | * | 8/1993 | Mutso et al. | 358/246 |
| 5,321,160 | * | 6/1994 | Hironaka et al. | 564/480 |
| 5,733,599 | * | 3/1998 | Ferrier et al. | 427/98 |

FOREIGN PATENT DOCUMENTS

| | | | |
|---|---|---|---|
| 59-136489 | * | 8/1984 | (JP) . |
| 2-61073 | | 3/1990 | (JP) . |
| 2-18582 | | 7/1990 | (JP) . |
| 3-153879 | | 7/1991 | (JP) . |
| 07034254 | | 2/1995 | (JP) . |

* cited by examiner

*Primary Examiner*—Shrive Beck
*Assistant Examiner*—Michael Barr
(74) *Attorney, Agent, or Firm*—Pillsbury Madison & Sutro LLP

(57) ABSTRACT

A composite plated metal material having a composite coating layer with excellent adhesion and mechanical properties is produced by (1) displace deposition-plating a metal I base material with a metal II having a nobler oxidation-eduction potential than that of metal I and (2) dope-modifying the resultant metal II coating layer with a metal III-containing deposit in which metal III is different from metal II and exhibits a nobler oxidation-reduction potential than that of metal I, by using a displace deposition-plating aqueous solution containing metal III-containing compound ions.

4 Claims, 3 Drawing Sheets

DISPLACE DEPOSITION-PLATED AND DOPING-MODIFIED METAL MATERIAL AND PROCESS FOR PRODUCING SAME

BACKGROUND OF THE INVENTION

1. Field of the Invention

The present invention relates to a process for producing a metal material having a displace deposition-plated and doping-modified composite coating layer, and a metal material produced by the process mentioned above and having a displace deposition-plated and doping-modified composite coating layer. More particularly, the present invention relates to a process for producing a metal material which has a displace deposition-plated and doping modified composite coating layer formed by applying a displace deposition-plating procedure onto a surface of a metal base material, for example, aluminum or ferrous base material, and then applying a doping-modifying procedure to the displace deposition-plated coating layer to provide a composite coating layer having an improved adhesion and an enhanced denseness, and a metal material produced by the above-mentioned process, and provided with a displace deposition-plated and doping-modified composite coating layer.

2. Description of the Related Art

Generally, plating processes for forming a metal coating on a target metal material surface by reducing and depositing metal ions contained in a plating solution are classified, in view of the reduction method applied thereto, into the following groups. Namely, the plating processes include electric plating processes in which the reduction is carried out by externally supplying electrons produced by a cathode electrolysis into the plating liquid; chemical plating processes in which the reduction is effected by adding a reducing agent into a plating liquid; and displace deposition plating processes wherein the plating metal ions are reduced by utilizing an electron emission phenomenon generated due to a dissolution (ionization) of a metal from which the metal base material is formed.

The present invention utilizes a displace deposition plating process. In a displace deposition plating system, when the plating metal exhibits an oxidation-reduction potential (redox potential) not nobler than the oxidation-reduction potential of the metal from which the metal base material is formed, no displace deposition plating occurs.

Namely, the displace deposition plating can be effected by the following reactions;

$$mMe_{I} \rightarrow mMe_{I}^{n+} + mne \quad \text{(Chemical reaction formula 1)}$$

$$nMe_{II}^{m+} + mne \rightarrow nMe_{II} \quad \text{(Chemical reaction formula 2)}$$

In the above-mentioned formulae 1 and 2, $Me_{I}$ represents a metal from which a metal base material to be plated is formed, $Me_{II}$ represents a plating metal, e represents an electron, and m and n represent ionic valences of the metals $Me_{I}$ and $Me_{II}$ ionized in an aqueous plating solution, respectively.

First, when a metal $Me_{I}$ is ionized and dissolved in an amount of m moles in the aqueous solution in accordance with the chemical formula 1, electrons are emitted in the number of mn per m moles of the metal $Me_{I}$. In this case, when an oxidation-reduction potential of a plating metal $Me_{II}$ is nobler than that of the metal $Me_{II}$, the plating metal ions $Me_{II}^{m+}$in an amount of n moles in the plating solution receive the electrons in the number of mn and are reduced into metal $Me_{II}$ in accordance with the chemical formula 2, and the resultant metal $Me_{II}$ deposits on the metal base material $Me_{I}$ to form a plated coating layer.

As the above-mentioned mechanism of the displace deposition plating clearly shows, a progress in the coating of the metal base material surface with a plating metal in accordance with the chemical reaction formulae 1 and 2 causes the contact of the metal base material surface with the plating liquid to be difficult and thus the progress in the reaction in accordance with the chemical reaction formula 1 to be obstructed, and then the plating reactions are terminated. This fact shows that, in the displace deposition plating process, the control in the thickness of the plated metal coating layer is very difficult in comparison with that of the electric and chemical plating processes in which the thickness of the target plated coating layer increases substantially proportionally with the plating time.

Where the target plated coating layer is allowed to be relatively thin, the plating reactions in accordance with the chemical reaction formulae 1 and 2 may be stopped before the reactions are completed. However, in this case, the resultant plated coating layer is very rough and has a porous structure, and thus the metal base material surface covered by the plated porous coating layer has a possibility to partially contact with the plating liquid. This plated porous coating layer is disadvantageous in that the mechanical strength and the adhesion with the metal base material surface are unsufficient and the corrosion resistance is poor, and thus is unsatisfactory for practical use.

To solve the above-mentioned problems of the conventional displace deposition plating processes, various attempts were made depending on the combinations of the type of metal from which the metal base material is formed with the type of target plating metal. For example, Japanese Unexamined Patent Publication 2-61,073 discloses a process for plating a copper base plate surface with a tin coating layer having a fine and dense structure at a high speed, and Japanese Unexamined Patent Publication No. 2-185,982 discloses a process for plating a steel base plate surface with a copper coating layer having a high adhesion. In each of the above-mentioned processes, the composition of the plating liquid, especially the additives, is improved to solve the above-mentioned problems. Also, Japanese Unexamined Patent Application No. 3-153,879 discloses a process for plating a tin solder-coating layer having a large thickness on a copper base plate surface, and Japanese Unexamined Patent Publication No. 7-34,254 discloses a process for plating a zinc coating layer having a high adhesion on an aluminum base plate surface. In each of these processes, a pre-treating procedure before the displace deposition plating procedure and a post-treating procedure after the displace deposition plating procedure are improved, to overcome the problems of the conventional processes.

In the above-mentioned processes, however, special means, in response to the combination of the type of the metal base material and the type of the target plating metal, must be taken. Namely, these processes can be utilized only for special purposes but not for general displace deposition plating purposes. Therefore, these prior processes are disadvantageous in that a complicated measure to attain the purpose is necessary, and the plating liquid composition and the plating procedures are complicated. On other hand, in the electric and chemical plating processes, to impart various functions to the plated coating layer, a alloying method, namely a alloy-plating method, and a dispersion plating method in which fine solid particles are dispersed in a plating liquid and co-deposited in a plated coating layer, are carried out.

However, in the displace deposition plating processes, since the oxidation-reduction potential of the plating metal must be nobler than that of the metal base material, there is a limitation to the type of the metals to be alloyed and usable for the displace deposition plating processes. Also, even if the alloying can be effected, among a plurality of the metals, the noblest metal, in oxidation-reduction potential, selectively deposits with top priority, and therefore, such a problem that the composition of the resultant plated coating layer is difficult to control occurs. Further, when the dispersion plating method is applied to the displace deposition plating process, since, as mentioned above, the control in the thickness and mechanical properties of the plated coating layer in the displace deposition plating processes is difficult, the application of the dispersion plating method to the displace deposition plating procedure for forming an outermost functional surface layer is insuitable and no practical use has been reported.

Namely, in almost all of the practical displace deposition plating processes, a single metal is plated and thus the properties of the plated coating layers are limited in practice.

As a case in which the displace deposition plating process must be industrially used, in other words, other plating processes are difficult to practically utilize, only a zincate treatment (displace deposition zinc plating) is known. This zincate treatment is carried out as a pre-treatment for the purpose of enhancing adhesion of a target plating metal to a surface of a aluminum-coating material.

As mentioned above, the conventional displace deposition plating processes have disadvantages to be solved. However, the displace deposition plating processes are industrially advantageous in that plating equipment is very simple and plating cost is low, in comparison with the electric plating processes, because a electricity supply for the plating procedure, which electricity supply is indispensable for the electric plating processes, is unnecessary; and the plating liquid has a simple composition and a high chemical stability in comparison with the chemical plating processes. Therefore, it is very advantageous for industry to improve the displace deposition plating processes and to expand the industrially applicable field thereof.

SUMMARY OF THE INVENTION

An object of the present invention is to provide a process for producing a metal material having a displace deposition-plated and doping-modified composite coating layer, which process is widely useful as a functional surface treating process for a metal base material, without losing or decreasing the advantages in low cost and high stability of the conventional displace deposition plating processes, and a metal material produced by the above-mentioned process and having a displace deposition-plated and doping-modified composite coating layer. Particularly, an object of the present invention is to provide a process for producing a metal material having a displace deposition-plated and doping-modified composite coating layer, which process is capable of reducing the dependency of the mechanical properties and adhesion of the displace deposition-plated coating layer on the thickness of the coating layer, of imparting excellent mechanical properties to the coating layer in a wide range of thickness of the coating layer, of modifying the displace deposition-plated coating layer with other metal or compound, to form a composite coating layer, and of imparting an improved performance to the coating layer, and a metal material produced by the above-mentioned process and having a displace deposition plated and doping-modified composite coating layer.

The above-mentioned objects can be attained by the process of the present invention and the product of thereof.

The process of the present invention for producing a displace deposition-plated and doping-modified metal material, comprises the steps of;

(1) bringing a surface of a metal base material comprising a metal I into contact with an aqueous solution (A) containing ions of at least one metal II having an oxidation-reduction potential nobler than that of the metal I, to cause the metal II to be displace deposition-plated on the surface of the metal I base material, and to form a displace deposition plated-coating layer of the metal II; and (2) bringing the displace deposition-plated coating layer of the metal II into contact with an aqueous solution (B) containing ions containing at least one metal III different from the metal II and having an oxidation-reduction potential nobler than that of the metal I to cause the metal II displace deposition-plated coating layer to be doped and modified with a metal III-containing substance deposited from the aqueous solution (B).

The displace deposition-plated and doping-modified metal material of the present invention produced by the process, as mentioned above, comprises a metal base material comprising a metal I, and a composite coating layer formed on a surface the metal I base material by displace deposition plating with at least one metal II having a nobler oxidation-reduction potential than that of the metal I and further displace deposition plating with a substance containing at least one metal III different from the metal II and having a nobler oxidation-reduction potential than that of the metal I to dope the displace deposition plated metal II coating layer with the metal III-containing substance.

DESCRIPTION OF THE PREFERRED EMBODIMENTS

Figure 1:
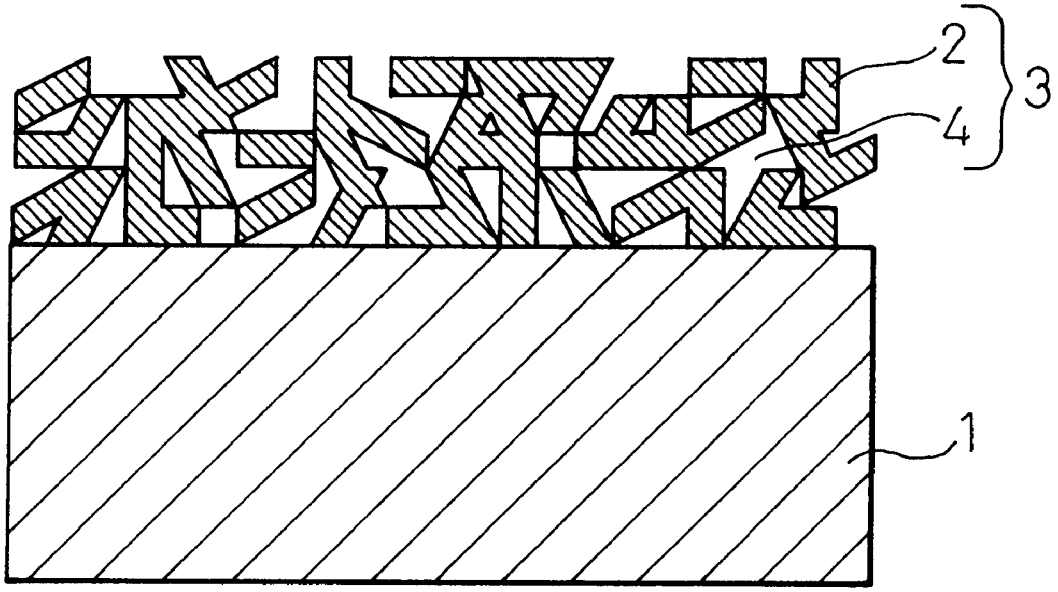
FIG. 1 is a view of an explanatory cross-sectional profile of an embodiment of a displace deposition-plated coating layer formed on a metal base material in accordance with the first step of the process of the present invention.

The inventors of the present invention have made extensive study for solving the problems of the prior displace deposition plating processes, and have found that the problems could be solved by positively utilizing the specific feature that, due to the coating layerforming mechanism of the displace-deposition plating process, the resultant displace deposition-plated coating layer is porous, and chemically doping a substance containing a metal different from the metal base material and the displace deposition-plating metal into the porous structure of the displace deposition-plated coating layer. The present invention was completed based on the above-mentioned finding.

In the process of the present invention for a metal material having a displace deposition-plated and doping-modified composite coating layer comprises the following steps (1) and (2).

In step (1) a surface of a metal base material comprising a metal I is brought into contact with an aqueous solution (A) containing ions of at least one metal II having a nobler oxidation-reduction potential than that of the metal (I) to form a displace deposition-plated coating layer comprising the metal II on the metal I base material surface.

The displace deposition-plated metal II coating layer formed on the metal I base material surface by step (1) has a porous structure in which a plurality of fine empty spaces, namely pores or voids, are formed.

In step (2), the metal II displace-deposition-plated coating layer is brought into contact with an aqueous solution (B) containing ions containing at least one metal III which is different from the metal II and has a nobler oxidation-reduction potential than that of the metal I, to dope a substance containing the metal III deposited from the aqueous solution (B) into the metal II displace deposition-plated coating layer, and to form a modified composite coating layer.

In step (2), the deposited metal III-containing substance penetrates into the displace deposition-plated metal II coating layer formed by step (1) and fills the pores in the plated metal II coating layer, to modify the plated metal II coating layer and form a composite coating layer. Namely, the doping of the displace deposition-plated metal II coating layer with the metal III-containing deposit significantly contributes to enhancing the adhesion of the coating layer to the metal base material, and the corrosion resistance, denseness and mechanical strength of the coating layer.

The aqueous solution (B) containing the metal III-containing ions includes aqueous solutions containing ions of metal III, and aqueous solutions containing complex ions consisting of at least one metal III atom and at least one other element atom, namely metal III compound ions, for example, metal III-containing oxo-acid ions, metal III-containing sulfide ions and metal III-containing fluoride ions. In the present invention, the metal III-containing complex ions consisting of at least one metal III atom and at least one other element atom are included in the term metal III compound ions, and the metal III-containing ions include the metal III ions and the metal III compound ions.

In the process of the present invention, the metal I for forming at least a surface of the metal base material is not limited to specific types of metals. Preferably, the metal I is selected from the group consisting of aluminum, aluminum alloys, iron, iron alloys, copper, copper alloys, zinc and zinc alloys. The metal I may form an outermost covering layer of a metal base material.

In the process of the present invention, the metal III usable for the displace deposition plating step (1) of the process of the present invention is not limited to specific type of metals, as long as the oxidation-reduction potential of the metal II is nobler than that of the metal I. Usually, the metal II is preferably selected from the group consisting of tin, lead, indium, zinc, copper, iron, nickel, cobalt, gold, silver, platinum, palladium, rhodium, and iridium. The above-mentioned metals II can be employed alone or in a mixture of two or more thereof. Among the above-mentioned metals, tin, lead, zinc, copper, iron, nickel and cobalt are more preferably employed. In step (1) in which the displace deposition-plated metal II coating layer is formed on the metal I base material surface, there is no specific limitation to the composition of the aqueous plating solution (A). The aqueous plating solution (A) may be acidic or basic.

When the metal I of the metal base material is selected from amphoteric metals, for example, zinc materials and aluminum materials, the displace deposition-plating bath (A) for forming the plated metal II coating layer thereon may be acidic or alkaline. Also, when the metal I of the metal base material is selected from iron materials and copper materials, the displace deposition-plating bath (A) for forming the plated metal II coating layer thereon must be acidic, for the coating layer-forming ionic reactions. Further, when the metal II is selected from the group consisting of tin, lead, indium, zinc, copper, iron, nickel, cobalt, gold, silver, palladium, rhodium and iridium, the displace deposition plating bath (A) is not necessary to be added with a specific additive as long as the metal II is ionized in the plating bath (A). However, the deposition rate and the porosity of the displace deposition-plated coating layer of the metal II can be controlled to a certain extent by adding an additive to the plating bath (A). Therefore, in consideration of the target amount of the metal III to be doped into the displace deposition-plated metal II coating layer, the target thickness of the composite coating layer, and the ease of the operation, an additive is optionally added to the displace deposition-plating bath (A).

The metal III compound for forming a metal III-containing deposit to be doped into the displace deposition-plated metal II coating layer may be selected from those capable of imparting a desired property to the target composite coating layer, as long as the oxidation-reduction potential of the metal III is nobler than the oxidation-reduction potential of the metal I. Usually, the working metal III is preferably selected from the group consisting of molybdenum, tungsten, vanadium, rhenium, chromium, manganese, antimony, titanium, zirconium, copper, tin, lead, indium iron, zinc, nickel platinum, cobalt, gold, silver, palladium, rhodium, and iridium. More preferably, the metal III is selected from molybdenum, tungsten, vanadium, rhenium, chromium, manganese, antimony, copper, tin, lead, iron, inc, nickel and cobalt.

The metal III compound is preferably selected from compounds capable of generating metal III-containing complex ions, for example, metal III-containing oxo-acid ions, metal III-containing sulfide ions and metal III-containing fluoride ions. The metal III-containing complex ion-generating compounds are selected from complexion-generating compounds of at least one metal selected from, for example, molybdenum, tungsten, vanadium, rhenium, chromium, manganese, antimony, titanium and zirconium.

The metal III-containing complex ions contained in the plating bath (B) are reduced in the doping step (2), and are converted mainly into oxides, hydrated oxides, sulfur-containing compounds or fluorine-containing compounds of the metal III, and are deposited in the fine empty spaces (pores or voids) of the displace deposition-plated metal II coating layer formed by the displace deposition-plating step (1), to dope and modify the metal II coating layer. The above-mentioned metal III compounds mostly have an amorphous or microcrystalline structure, and thus can very densely fill the fine empty spaces of the metal II coating layer. This doping of the metal II coating layer with the metal III compounds is advantageous for a use in which the resultant composite coating layer must have a high mechanical strength. Further, when chromium or manganese is used as a metal III, the resultant composite coating layer doped with the compounds of these metals exhibits a very high corrosion resistance.

When, as a metal III compound, a compound of copper, tin, lead, indium, iron, zinc, nickel, cobalt, gold, silver, platinum, palladium, rhodium or iridium which can be easily reduced to a metal state, is used, preferably, the fine empty spaces (pores or voids) of the metal II coating layer are filled by the reduced metal in the doping step. Preferably, the doped metal III is alloyed in the metal II coating layer to impart a desired function to the resultant composite coating layer. In the case where the metal III in the state of a metal is doped in the metal II coating layer, the resultant composite coating layer has a two layered structure, because the metals II and III are deposited in separate displace deposition-plating procedures. This two-layered structure can be converted to a single layered structure by applying a heat treatment thereto. In the heat treatment, the metals II and III are alloyed or reacted with each other to deposit an intermetallic compound. Namely, the structure of the composite coating layer can be optionally controlled by a certain post treatment.

The composition of the plating aqueous solution (B) containing the metal III compound ions can be adjusted in consideration of the type of the metal I of the metal base material, in the same manner as in the aqueous solution (A) containing the metal II ions. Namely, when the metal I of the metal base material is an amphoteric metal, for example, zinc or aluminum material, the metal III compound-containing aqueous plating solution may be acidic or alkaline. When the metal I of the metal base material is an iron material or a copper material, the metal III compound-containing aqueous plating solution is preferably acidic.

Also, when the metal III is selected from molybdenum, tungsten, vanadium, rhenium, chromium, manganese, antimony, titanium and zirconium, which mostly form compounds having an amorphous or microcrystalline structure, this type of metal III forms a sufficiently dense deposit in the displace deposition plating step (2). Therefore, in this case, the displace deposition plating aqueous solution (B) does not need any additive for enhancing the denseness of the metal III-containing deposit.

When the metal III is selected from copper, tin, lead, indium, iron, zinc, nickel, cobalt, gold, silver, platinum, palladium, rhodium and iridium, which are doped in the state of a metal into the displace deposition-plated metal II coating layer, an addition of the additive to the doping aqueous solution (B) can control the conditions of the doped metal III. In any case, the aqueous solution (B) may be added with an additive, for example, a pH modifier, for example, an acid or alkali for controlling the pH value of the aqueous solution (B) to a desired level, a stabilizer for the metal ions, or a complex compound for controlling the deposition potential or deposition rate of the aqueous solution (B). The additive should be selected in response to the desired doping condition and amount and the ease of the plating operation in the step (2).

The metal III-containing deposit which is dispersed and deposited in the displace deposition-plated metal II coating layer, by the step (2) of the process of the present invention, is used for the purpose of filling the fine empty spaces (pores or voids) in the metal II coating layer, and thus the metal III-containing deposit may consist essentially of a compound or alloy of the metal III with other substance or the metal III per se, as long as the deposit comprises the metal III. Accordingly, when the displace deposition plated metal II coating layer is formed, and then a metal III compound is doped into the metal II coating layer, the aqueous doping solution must contain metal III compound ions or metal III ions.

To normally carry out the doping reaction with the metal III-containing deposit, the oxidation-reduction potential in the oxidation-reduction reaction between the metal III-containing ions and the metal III compound must be nobler than the oxidation-reaction potential in the oxidation-reduction reaction between the metal I of the metal base material and the ions of the metal I. Accordingly, the ionic valence of the metal III contained in the metal III compound ions dissolved in the aqueous solution (B), from which the metal III-containing deposit is generated, is larger than the ionic valence of the metal III contained in the metal III-containing deposit which is finally disperse-deposited and doped into the displace deposition-plated metal II coating layer. In other words, the disperse-deposited metal III-containing deposit is produced by reduction of the metal III compound ions in the aqueous solution (B).

Namely, in the doping reaction of the metal III-containing deposit with the displace deposition-plated metal II coating layer, since the displace deposition-plated metal II coating layer is porous, the aqueous solution (B) containing the metal III-containing ions can penetrate and diffuse into the metal II coating layer and reach the surface of the metal I base material. Therefore, the doping reaction is effected in such a manner that the metal III-containing ions accept electrons emitted by the ionization reaction (oxidation reaction) of the metal I of the metal base material and thus are reduced.

The doping reaction in the step (2) of the process of the present invention is further advantageous in that in the displace deposition-plated metal II coating layer formed on the metal I base material, the metal II has a nobler oxidation-reduction potential than the oxidation-reduction potential of the metal I. Therefore, when the aqueous solution (B) containing the metal III-containing ions come into contact with the metal I of the metal base material in the above-mentioned manner, the metal I located in the metal base material surface serves as an anode, and the metal II located in the plated metal II coating layer surface, brought into contact with the metal I and having a nobler oxidation-reduction potential than that of the metal I serves as a cathode, and thus an oxidation-reduction reaction between the metal III-containing ions and the metal III compound occurs. Accordingly, the reduction reaction of the metal III-containing ions into the metal III compound occurs mainly and selectively on the plated metal II coating layer surface which serves as a cathode, and as a result, the fine empty spaces in the displace deposition-plated metal II coating layer are uniformly filled by the metal III-containing deposit.

The process of the present invention including the displace deposition-plating step (1) with the metal II and the doping step (2) with the metal III-containing deposit will be further explained with reference to FIGS. 1 and 2.

In FIG. 1, by the step (1) of the present invention, metal II 2 deposits on a metal base material 1 comprising a metal I to form a displace deposition-plated coating layer 3. In the coating layer 3, a plurality of fine empty spaces 4 are formed. Thus, the displace deposition-plated metal II coating layer 3 has, as a whole, a porous structure having a plurality of fine empty spaces (pores or voids).

Figure 2:
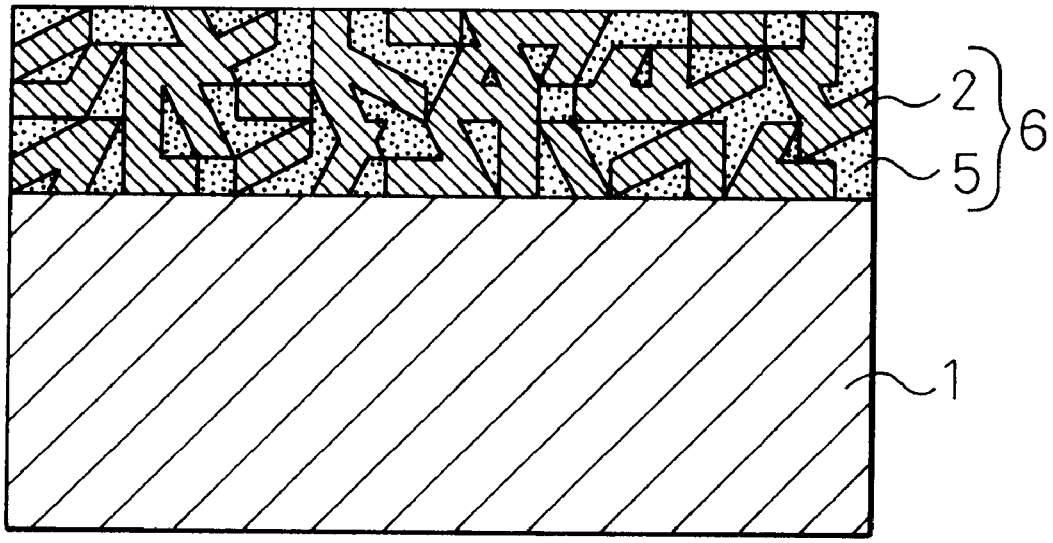
FIG. 2 is a view of an explanatory cross-sectional profile of an embodiment of a displace deposition-plated and doping-modified composite coating layer formed on a metal base material in accordance with the first and second steps of the process of the present invention.

In FIG. 2, when a doping step (2) of the process of the present invention with a metal III-containing deposit is applied to the displace deposition-plated metal II coating layer 3, the fine empty spaces 4 in the metal II coating layer 3 are filled with the metal III-containing deposit 5, to form a dope-modified composite coating layer 6 comprising the displace deposition-plated metal II 2 and the metal III-containing deposit 5 filling the fine empty spaces 4. As mentioned above, when the porous displace deposition-plated metal II coating layer is doped with the metal III-containing deposit, to form a composite coating layer, not only the mechanical properties and the adhesion of the metal II coating layer are improbed, but also another various functions can be imparted to the coating layer by controlling the type and composition of the metal III-containing deposit.

The process of the present invention is further advantageous in that the displace deposition-plating step (1) with the metal II does not need a specific accurate control. In a conventional displace deposition-plating procedure, it is necessary that various additive must be added to the plating solution to enhance the adhesion between the metal base material and the resultant coating layer and that the composition of the plating solution must be designed so that the resultant coating layer has a high denseness even if the thickness of the coating layer is unsatisfactory. The necessity causes the composition of the plating solution to become complicated, the control of the plating solution to become difficult, and various combination of various means for solving the above-mentioned problems to be selected in response to each of various combinations of the type of the metal I and the type of the metal II for the displace deposition-plated coating layer.

Compared with the conventional process, in the process of the present invention, since the step (1) for forming the displace deposition-plated metal II coating layer and the doping step (2) with the metal III-containing deposit are separately carried out from each other, the plated metal II coating layer formed by the displace deposition-plating step (1) is allowed to be a porous coating layer, and sometimes, the porous coating structure is beneficial for the purpose of obtaining a high thickness coating layer. Also, as long as the order of nobleness in oxidation-reduction potential the metal I for the metal base material and the metal III compound satisfy the requirement of the present invention, the doping step (2) can be carried out irrespective of the type of the metal II.

EXAMPLES

The present invention will be further illustrated by the following examples which are merely representative and do not limit the scope of the present invention in any way.

Example 1

An aluminum alloy material (JIS AC8A) having a diameter of 50 mm and a length of 10 mm was surface cleaned with an alkali digressing agent, and then immersed in an aqueous solution of 70 g/liter of $K_2SnO_3 \cdot 3H_2O$ at a temperature of 60° C. for 3 minutes to apply an alkalin displace deposition-plating treatment with tin to the aluminum alloy material. Then, the tin-plated coating layer was immersed in an aqueous solution of 50 g/liter of $Na_2MoO_4 \cdot 2H_2O$ at a temperature of 70° C. for 3 minutes to dope and modify the tin-plated coating layer with a molybdenum oxide.

An adhesive tape was attached to the resultant displace deposition-plated and dope-modified composite coating layer surface and strongly pressed by finger nails, and then peeled off from the composite coating layer. No change was found on the composite coating layer.

A sample of the aluminum alloy material having the composite coating layer was embedded into an epoxy resin to provide a specimen for electron microscopic testing. The specimen was cut to provide a cross-section of the composite coating layer.

The cross-section was polished, the polished cross-section was subjected to a scanning electron microscopic (SEM) observation. The resultant photograph is shown in FIG. 3A.

Figure 3A:
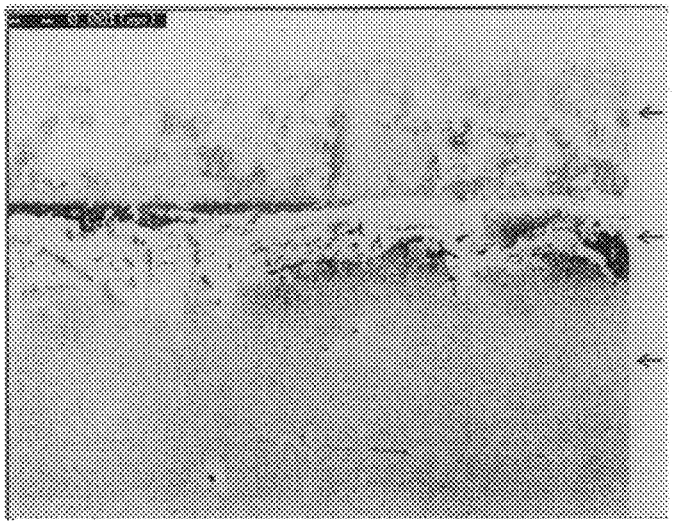
FIG. 3A is a scanning electron microscopic photograph showing a cross-section of an embodiment of a displace deposition-plated and doping-modified composite coating layer formed in Example 1 in accordance with the process of the present invention.

In FIG. 3A, it was confirmed that the composite coating layer had a thickness of about 4$\mu$m. Also, the cross-section of the specimen was subjected to an electron probe microanalyzer (EPMA) to establish the distribution of tin and molybdenum in the composite coating layer. The results are shown in FIGS. 3B and 3C.

Figure 3B:
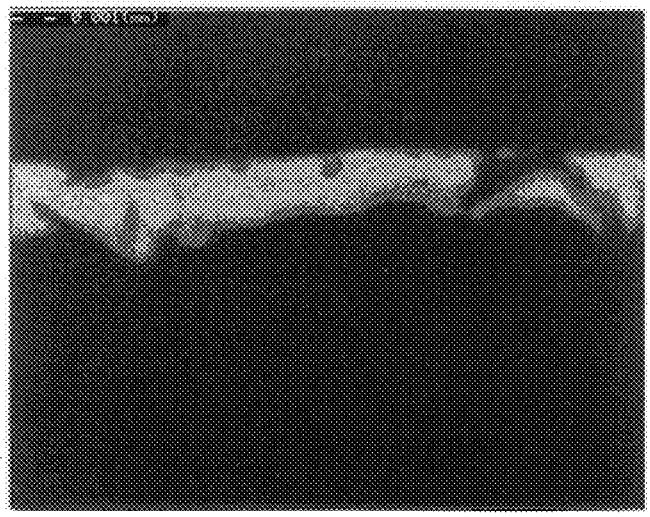
FIG. 3B shows a Sn-mapping view of the composite coating layer shown in FIG. 3A, by an electron probe X-ray microanalyzer at a magnification of 3000.
Figure 3C:
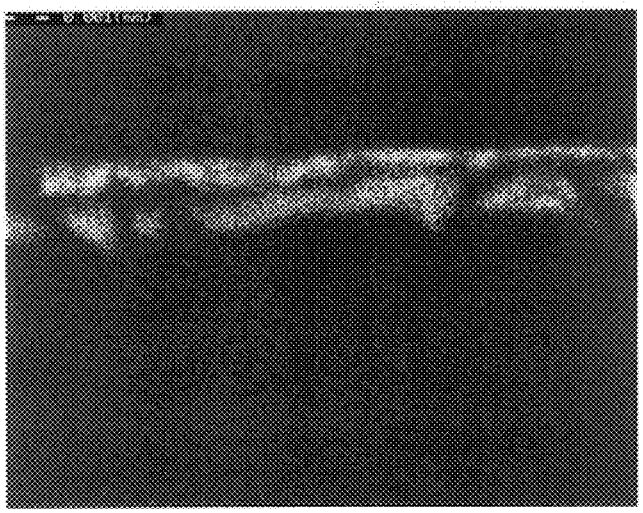
FIG. 3C shows a Mo-mapping view of the composite coating layer shown in FIG. 3A, by an electron probe X-ray microanalyzer at a magnification of 3000.

In view of FIGS. 3B and 3C, the distributions of tin and molybdenum are approximately in accord with each other, and thus in view of FIGS. 3A, 3B and 3C, it was confirmed that the molybdenum oxide is disperse-deposited in the displace deposition-plated tin coating layer.

Example 2

An aqueous solution of a mixture of 25 g/liter of $SnSO_4$ with 7 g/liter of $Sn(BF_4)_2$ and 20 g/liter of 98% $H_2SO_4$ was added with 0.1 g/liter of an acetyleneglycol surfactant as an additive for enhancing the denseness of crystals, and the temperature of the resultant aqueous solution was kept at a level of 30° C.

Separately, the same aluminum alloy material as in Example 1 was surface-cleaned using an alkali digreasing agent.

The cleaned aluminum alloy material was immersed in the above-mentioned aqueous solution for 3 minutes to apply an acidic displace deposition plating treatment with tin to the aluminum alloy material. Then, the tin-plated coating layer was immersed in an aqueous solution of 65 g/liter of $Na_2WO_4 \cdot 2H_2O$ at a temperature of 70° C. for 3 minutes to dope-modify the tin-plated coating layer with a tungsten oxide.

An adhesive tape was attached to a surface of the resultant composite coating layer, strongly pressed with finger nails, and then peeled off from the composite coating layer surface.

No change was found on the composite coating layer surface.

A sample of the composite plated aluminum alloy material was embedded into an epoxy resin to provide a specimen for electron microscopic testing. The specimen was cut to provide a cross-section of the composite coating layer.

Figure 4A:
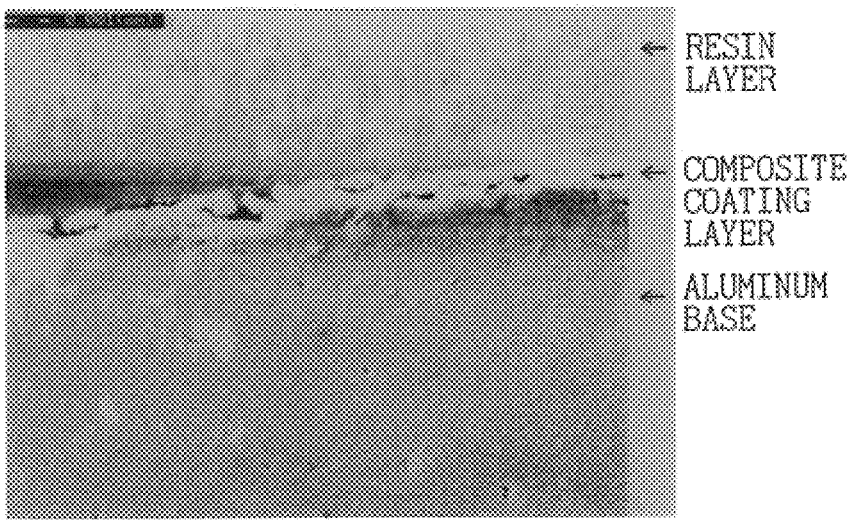
FIG. 4A is a scanning electron microscopic photograph showing a cross-section of an embodiment of a displace deposition-plated and doping-modified composite coating layer formed in Example 2 in accordance with the process of the present invention.

The cross-section was polished, the polished cross-section was subjected to a scanning electron microscopic (SEM) observation. The resultant photograph is shown in FIG. 4A.

Figure 4B:
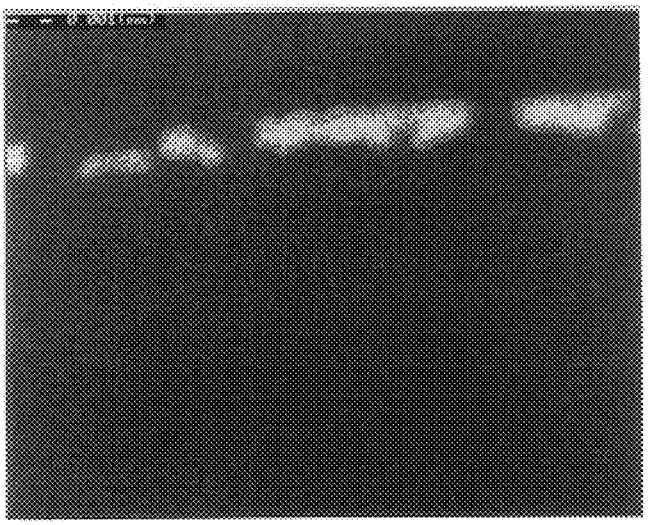
FIG. 4B shows a Sn-mapping view of the composite coating layer shown in FIG. 4A, by an electron probe X-ray microanalyzer at a magnification of 3000.
Figure 4C:
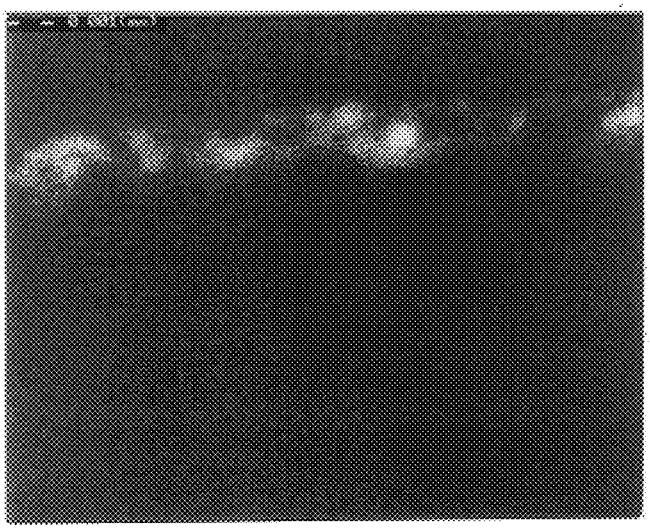
FIG. 4C shows a W-mapping view of the composite coating layer shown in FIG. 4A, by an electron probe X-ray microanalyzer at a magnification of 3000.

In FIG. 3A, it was confirmed that the composite coating layer had a thickness of about 2 $\mu$m. Also, the cross-section of the specimen was subjected to an electron probe microanalyzer (EPMA) to establish the distribution of tin and tungsten in the composite coating layer. The results are shown in FIGS. 4B and 4C. In view of FIGS. 4B and 4C, the distinctions of tin and tungsten are approximately in accord with each other, and thus in view of FIGS. 4A, 4B and 4C, it was confirmed that the tungsten oxide is disperse-deposited in the displace deposition-plated tin coating layer.

In FIGS. 3B and 4B, partial defects were found in the Sn mapping view of the displace deposition-plated tin coating layer. The defects were derived from residue of Si which was deposited in the AC 8A material used as a metal base material, and not removed by an etching action during the displace deposition tin-plating procedure.

Comparative Example 1

By the same procedures as in Example 1, a displace deposition tin-plated coating layer was formed on the aluminum alloy material surface by the alkaline displace deposition plating. An adhesive tape was attached to the surface of the tin coating layer, strongly pressed by finger nails, and peeled off from the tin coating layer surface. It was confirmed that almost all of the tin coating layer was removed together with the adhesive tape from the aluminum alloy material surface.

Comparative Example 2

By the same procedures as in Example 2, a displace deposition tin-plated coating layer was formed on the aluminum alloy material surface by the acidic displace deposition plating. An adhesive tape was attached to the surface of the tin coating layer, strongly pressed by finger nails, and peeled off from the tin coating layer surface. It was confirmed that a portions of the tin coating layer were removed together with the adhesive tape from the aluminum alloy material surface.

Example 3

By the same procedures as in Example 1, a displace deposition tin-plated coating layer was formed on the aluminum alloy material surface by the alkaline displace deposition plating. The resultant tin-plated aluminum alloy material was immersed in an aqueous solution of 20 g/liter of $NH_4VO_3$ at a temperature of 70° C. for 3 minutes to dope-modify the displace deposition tin-plated coating layer with vanadium oxide. An adhesive tape was attached to the surface of the resultant composite coating layer, strongly pressed by finger nails, and peeled off from the tin coating layer surface. It was confirmed that no change occurs on the composite coating layer.

Example 4

By the same procedures as in Example 1, an aluminum alloy material was plated with tin by using an alkaline displace deposition tin-plating solution.

Separately, an aqueous doping solution was prepared by mixing an aqueous solution of 3 g/liter of $CrO_3$ with 0.3 g/liter of $HNO_3$ as a pH-adjustor and 1 g/liter of HF as an etching agent for aluminum and heated to a temperature of 40° C.

The tin-plated aluminum alloy material was immersed in the aqueous doping solution for one minute, to dope and modify the displace deposition-plated tin coating layer with chromium oxide hydrate.

An adhesive tape was attached onto the resultant composite coating layer surface, strongly pressed by finger nails and peeled off from the composite coating layer surface. No change was found on the composite coating layer surface.

A sample of the composite plated aluminum alloy material was subjected to an accelerated corrosion test using a salt spray tester in accordance with JIS Z 2371, for one week. As a result, no rust was found on the tested sample.

Example 5

An aqueous solution containing 100 g/liter of NaOH, 20 g/liter of ZnO, 1 g/liter of $NiSO_4 \cdot 6H_2O$, 5 g/liter of $CoSO_4 \cdot 7H_2O$ and 5 g/liter of $FeSO_4 \cdot 6H_2O$ was prepared and heated to a temperature of 40° C.

The same aluminum alloy material as in Example 1 was surface-cleaned with an alkali digreasing agent, and immersed in the above-mentioned aqueous solution for 3 minutes, to apply an alkaline displace deposition alloyed zinc plating procedure to the aluminum alloy material.

The resultant aluminum alloy material plated with the alloyed zinc coating layer was subjected to the same alkaline displace deposition plating treatment as in Example 1 with tin at a temperature of 60° C. for 3 minutes, to dope and modify the alloyed zinc coating layer with metallic tin.

An adhesive tape was attached onto the composite coating layer surface, strongly pressed by finger nails and peeled off from the composite coating layer surface. No change was found on the composite coating layer.

Comparative Example 3

By the same procedures as in Example 5, the aluminum alloy material was plated with an alloyed zinc by the alkaline displace deposition zinc alloy-plating procedure.

An adhesive tape was attached onto the resultant zinc alloy-plated coating layer surface, strongly pressed with finger nails and peeled off from the coating layer surface. Portions of the coating layer were removed together with the adhesive tape.

Example 6

An aluminum alloy material was plated with tin by the same alkaline displace deposition plating procedure as in Example 1 and the resultant tin coating layer was doped with a zinc alloy by the same alkaline displace deposition plating procedure as in Example 5 at a temperature of 40° C. for 3 minutes.

An adhesive tape was attached onto the resultant composite coating layer surface, strongly pressed with finger nails and then peeled off from the composite coating layer surface. Very small portions of the composite coating layer were removed with the adhesive tape.

Example 7

A cold rolled steel plate having dimensions of 70 mm×150 mm×0.88 mm was surface-cleaned with an alkali digressing agent, and then pickled with a 10% sulfuric acid aqueous solution at a temperature of 60° C. Separately, an aqueous solution containing 25 g/liter of $CuSO_4 \cdot 5H_2O$ and 10 mg/liter of 98% $H_2SO_4$ was prepared and heated to a temperature of 40° C.

The cleaned and pickled cold rolled steel plate was immersed in the acidic $CuSO_4$ aqueous solution for one minute to form a displace deposition-plated copper coating layer on the steel plate.

The copper-plated steel plate was immersed in an aqueous solution of 30 g/liter of $K[Sb(C_4H_2O_6)(H_2O)]$ at a temperature of 70° C. for 3 minutes to dope and modify the copper coating layer with an antimony compound.

An adhesive tape was attached onto the resultant composite coating layer surface, strongly pressed with finger nails and peeled off from the composite coating layer surface.

The composite coating layer was very slightly removed with the adhesive tape.

Comparative Example 4

A cold rolled steel plate was plated with copper by the same displace deposition copper plating procedure as in Example 7.

An adhesive tape was attached onto the copper coating layer surface, strongly pressed with finger nails and peeled off from the copper coating layer. As a result, almost all of the copper coating layer was removed with the adhesive tape.

Example 8

A zinc-electroplated steel plate having dimensions of 70 mm×150 mm×0.8 mm and a zinc layer thickness of about 20μm was surface-cleaned with an alkali digressing agent, and then immersed in the same displace deposition copper-plating solution as in Example 7 at a temperature of 40° C. for 30 seconds, to form a copper coating layer.

The copper-coated zinc-plated steel plate was immersed in an aqueous solution of 50 g/liter of $Na_2MoO_4 \cdot 2H_2O$ at a temperature of 70° C. for 3 minutes to dope and modify the copper coating layer with molybdenum oxide.

An adhesive tape was attached onto the resultant composite coating layer surface, strongly pressed with finger nails and peeled off from the composite coating layer surface. As a result, no change occurred on the composite coating layer.

Comparative Example 5

A cold rolled steel plate was plated with copper by the same displace deposition copper-plating procedure as in Example 8.

An adhesive tape was attached onto the resultant copper coating layer surface, strongly pressed with finger nails and peeled off from the copper coating layer surface. Almost all of the copper coating layer was removed with the adhesive tape.

Example 9

A zinc-electroplated steel plate having dimensions of 70 mm×150 mm×0.8 mm and a zinc layer thickness of about 20μm was surface-cleaned with an alkali digressing agent, and then immersed in the same displace deposition copper-plating solution as in Example 7 for 30 seconds, to form a copper coating layer.

The copper-coated zinc-plated steel plate was immersed in the same alkaline displace deposition tin-plating procedure as in Example 1 at a temperature of 60° C. for 3 minutes to dope and modify the copper coating layer with metallic tin.

An adhesive tape was attached onto the resultant composite coating layer surface, strongly pressed with finger nails and peeled off from the composite coating layer surface. As a result, no change occurred on the composite coating layer.

Example 10

A copper plate (JIS 100P) having dimensions of 70 mm×100 mm×0.8 mm was surface-cleaned with an alkali digreasing agent and pickled in a 10% HCl aqueous solution at room temperature.

The copper plate was immersed in an aqueous solution containing 30 g/liter of $SnCl_2$, 50 g/liter of a 36% HCl aqueous solution and 80 g/liter of $(NH_2)_2CSN$ which was an additive for controlling the oxidation-reduction potential of copper in the aqueous solution to a lower level, at a temperature of 60° C. for 3 minutes, to apply an acidic displace deposition tin plating treatment to the copper plate.

The resultant tin coating layer on the copper plate was immersed in an aqueous solution of a mixture of 20 g/liter of $PbCl_2$ with 50 g/liter of a 36% HCl aqueous solution and 80 g/liter of $(NH_2)_2CSN$ at a temperature of 60° C. for 3 minutes, to dope and modify the tin coating layer with metallic lead.

An adhesive tape was attached onto the resultant composite coating layer surface, strongly pressed with the finger nails and then peeled off from the composite coating layer. No change occurred on the composite coating layer.

When a sample of the composite coated copper plate was heated to a temperature of 220° C. which is slightly lower than the melting temperature of tin, 231.9° C., the melting of the composite coating layer was observed. From this phenomenon, it was confirmed that in the composite coating layer, tin was alloyed with lead to produce a solder.

Comparative Example 6

A tin coating layer was plated on the same copper plate by the same acidic displace deposition tin plating procedure as those in Example 10.

An adhesive tape was attached on the tin coating layer surface, strongly pressed with the finger nails, and then peeled off from the tin coating layer. As a result, almost all of the tin coating layer was removed with the adhesive tape.

In Examples 1 to 10 min accordance with the present invention, it was confirmed that the adhesion of the displace deposition-plated metal II coating layer to the metal I base material can be enhanced by treating the metal II coating layer with an aqueous solution containing metal III-containing ions. Particularly, in Example 1, the resultant composite coating layer having a large thickness of 4μm caused no problem. Also, in the analysis of the cross-sections of the composite coating layers formed in Examples 1 and 2, it was confirmed that the metal III-containing deposit generated by the displace deposition procedure with the aqueous solution containing the metal III-containing ions is disperse-deposited in the metal II coating layer.

Also, in Examples 4 and 10, it was confirmed that not only the enhanced adhesion, but also other properties, for example, an improbed corrosion resistance and melting temperature depression due to alloying, can be imparted to the composite coating layer by using an appropriately selected metal III.

In Comparative Examples 1 to 6, however, the resultant displace deposition-plated metal II layers exhibited an unsatisfactory adhesion to the metal base materials.

As described above, when a metal II coating layer formed on a metal I base material by a displace deposition plating procedure is dope-modified with a metal III-containing deposit generated from an aqueous solution containing metal III-containing compound ions, the resultant composite coating layer exhibits an enhanced adhesion to the metal base material and an improbed mechanical properties. Also, in accordance with the process of the present invention, a metal III-containing deposit can be disperse-deposited in the displace deposition-plated metal II coating layer, and thus a dope-modified composite coating layer having desired functions can be provided by using an appropriately selected metal III-containing deposit. Therefore, the process and the product of the present invention are useful for industrial practice.

We claim:

1. A process for producing a displace deposition-plated and doping-modified metal material, comprising the steps of;

(1) bringing a surface of a metal base material comprising a metal I selected from the group consisting of aluminum and aluminum alloys, into contact with an aqueous solution (A) containing ions of at least one metal II having an oxidation-reduction potential nobler than that of the metal I, and selected, in consideration of the type of the metal I used, from the group consisting of lead, indium, iron, nickel, cobalt, gold, platinum, rhodium, and iridium, to cause the metal II to be displace deposition-plated on the surface of the metal I base material, and to form a displace deposition plated-coating layer of the metal II; and (2) bringing the displace deposition-plated coating layer of the metal II into contact with an aqueous solution (B) containing ions containing at least one metal III different from the metals I and II, having an oxidation-reduction potential nobler than that of the metal I and selected, in consideration of the types of the metals I and II used, from the group consisting of molybdenum, tungsten, vanadium, manganese, antimony, tin, lead, iron, zinc, and cobalt, to cause the metal II displace deposition-plated coating layer to be doped and modified with a metal III-containing substance deposited from the aqueous solution (B).

2. The process as claimed in claim 1, wherein the metal III-containing ions are in the form of metal III compound ions selected from the group consisting of metal III-containing oxo-acid ions, metal III-containing sulfide ions and metal III-containing fluoride ions, and the oxidation-reduction potential in the oxidation-reduction reaction between the metal III-containing ions and the metal III compound is nobler than the oxidation-reduction potential in the oxidation-reduction reaction between the metal I of the metal base material and aluminum ions.

3. The process as claimed in claim 2, wherein the metal III contained in the metal III compound ions is selected from the group consisting of molybdenum, tungsten, vanadium, manganese, and antimony.

4. The process as claimed in claim 1, wherein the displace deposition plated layer of the metal II has a plurality of pores and the pores are filled with the metal III-containing substance deposited from the aqueous solution (B).

* * * * *